US006189239B1

(12) United States Patent
Gasparovic et al.

(10) Patent No.: US 6,189,239 B1
(45) **Date of Patent: *Feb. 20, 2001**

(54) ARTICULATED FOOTWEAR HAVING A FLEXURE MEMBER

(75) Inventors: David W. Gasparovic, Lake Oswego; William M. Dieter; Nancy M. Dalton, both of Portland, all of OR (US)

(73) Assignee: D. Gasparovic, Lake Oswego, OR (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/961,601

(22) Filed: Oct. 31, 1997

(51) Int. Cl.[7] ..... A43B 1/10

(52) U.S. Cl. ..... 36/102; 36/112; 36/138; 36/58.5

(58) Field of Search ..... 36/102, 103, 105, 36/112, 138, 51, 50.5, 58.5

(56) References Cited

U.S. PATENT DOCUMENTS

| | | | |
|---|---|---|---|
| 4,497 | * | 5/1846 | Vetter . |
| 75,048 | | 3/1868 | Perley . |
| 171,301 | * | 12/1875 | McKee . |
| 417,460 | | 12/1889 | Wurtele . |
| 474,574 | | 5/1892 | Bruzon . |
| 503,588 | | 8/1893 | Elterich . |
| 537,627 | * | 4/1895 | Bixby et al. . |
| 955,337 | * | 4/1910 | Lawlor . |
| 2,252,315 | * | 8/1941 | Doree . |
| 2,452,649 | | 11/1948 | Graves . |
| 2,619,744 | | 12/1952 | Mattes . |
| 3,146,535 | | 9/1964 | Owings . |
| 3,192,651 | | 7/1965 | Smith . |
| 4,095,356 | | 6/1978 | Robran et al. . |
| 4,309,832 | | 1/1982 | Hunt . |
| 4,507,879 | * | 4/1985 | Dassler . |
| 4,559,724 | * | 12/1985 | Norton . |
| 4,562,651 | | 1/1986 | Frederick et al. . |
| 4,573,457 | * | 3/1986 | Parks . |
| 4,615,126 | * | 10/1986 | Mathews . |
| 4,944,099 | * | 7/1990 | Davis . |
| 5,184,410 | * | 2/1993 | Hamilton . |
| 5,222,313 | | 6/1993 | Dowdy et al. . |
| 5,481,814 | * | 1/1996 | Spencer . |
| 5,570,523 | | 11/1996 | Lin . |

FOREIGN PATENT DOCUMENTS

| | | | |
|---|---|---|---|
| 28488 | * | 9/1913 | (GB) . |
| 1154145 | * | 6/1969 | (GB) . |
| 1358470 | * | 7/1974 | (GB) . |

* cited by examiner

*Primary Examiner*—Ted Kavanaugh
(74) *Attorney, Agent, or Firm*—Ipsolon LLP

(57) ABSTRACT

A article of footwear is disclosed having a flexure member in the sole to facilitate abduction bending to provide footwear that is easy to don and doff. The footwear includes a split upper having a forefoot upper portion and a rear upper portion. A closure mechanism is provided to hold the upper closed while the footwear is worn by a user.

7 Claims, 4 Drawing Sheets

ARTICULATED FOOTWEAR HAVING A FLEXURE MEMBER

BACKGROUND OF THE INVENTION

1. Field of the Invention

This invention pertains to the field of footwear.

2. Description of the Related Art

Typical footwear, particularly footwear for active use, has a sole and an upper. The upper includes a foot opening and a throat—an elongate opening that extends from the foot opening to a vamp. A tongue is located in the throat opening and a shoelace is laced through edges along the throat to provide a secure closure mechanism.

Such footwear is donned onto a foot by loosening the laces, spreading apart the foot opening and throat, holding the tongue out of the way and then inserting a foot through the opening into the footwear. The laces may then be tightened to secure the footwear onto the wearer's foot.

Donning footwear is a part of daily life for most people and it posses little difficulty. However, for parents, donning footwear on small children can be exasperating. Children are sometimes reluctant to hold still. The adult must hold the footwear open, hold the tongue out of the way and guide the child's foot into the footwear—difficult actions on a squirming child.

Other people also require assistance with putting on their footwear. For instance, people with limited leg mobility and people with infirmities such as Alzheimer's disease, often require assistance from others to don footwear.

U.S. Pat. No. 2,619,744 discloses a "foot enclosing device" intended for infants that includes a heel which opens to permit rear entry into the shoe. The shoe has side portions that meet at the heel. A flap overlies the side portions and secures the side portions in a closed position. When the flap is disengaged from the side portions and lowered, a child's foot may be inserted into the shoe through the now-open heel. This design appears to require that the adult use both hands to hold open the shoe sides while the foot is inserted. With both hands on the shoe, it is difficult to control a child's foot and position it for entry into the shoe.

Other U.S. patents also disclose footwear construction that appears to be intended to provide footwear that is easy to don. U.S. Pat. Nos. 5,481,814, 5,184,410, and 474,574 disclose footwear that have hinged soles and divided uppers. The U.S. Pat. No. 474,574 uses a pin hinge on the sole to allow the front to pivot relative to the rear. The U.S. Pat. No. 5,184,410 likewise discloses a hinge attached to the sole. The U.S. Pat. No. 5,481,814 provides a cut through a midsole and an outsole that acts as a hinge. Because the outsole is very flexible, it does not have sufficient bias force to hold the shoe in a closed arrangement on a wearer's foot. Accordingly, the U.S. Pat. No. 5,481,814 provides a metal biasing means with a tensioner (i.e., a spring) to urge the shoe closed.

Several deficiencies are noted in the prior art footwear. The '744 patent discloses a design that appears to require two hands to hold open to receive a foot. The U.S. Pat. Nos. 474,574 and 5,184,410 disclose designs that have a split sole with a ferroalloy mechanical hinge. The U.S. Pat. No. 5,481,814 discloses a design having a separated midsole and a hinge that is the outsole. To compensate for the weak closing force of the outsole hinge, the design of the U.S. Pat. No. 5,481,814 incorporates a metal biasing means.

The U.S. Pat. Nos. 5,481,814, 5,184,410, and 474,574 all incorporate hardware that is uncommon in active footwear.

As such, the hardware increases difficulty of manufacture, and expense. Furthermore, footwear soles endure significant stresses during use, and locating hardware in the sole invites failures that affect footwear performance.

Many footwear designs permit the sole to flex in a manner to accommodate movement of the foot during ambulation. During supination, the toes remain on the supporting surface while the heel moves upward, thus flexing the foot in a manner that shall be referred to as adduction, because the foot is bending inward on itself.

U.S. Pat. No. 4,559,724 discloses flex grooves aligned with a medial metatarsal-phalanges joint line and a second metatarsal-phalanges joint line. These flex grooves allow the sole to move with the foot during supination. These grooves do not facilitate flexing the sole in a direction that is opposite adduction, that is flexing that corresponds to abduction of the foot.

Footwear soles behave like beams. When flexed in the direction of adduction, the top and bottom are in compression and tension, respectively. When the sole is flexed in abduction, the forces reverse, that is the top is in tension and the bottom is in compression. Because of the structure of soles, and the location of the upper being fixedly attached to an upper margin of the sole, the dynamics of flexing the sole in adduction and abduction are significantly different.

SUMMARY OF THE INVENTION

The present invention provides footwear having a sole with a flexure member and a split upper so that the footwear can flex in abduction to assist with donning and doffing the footwear. In the preferred embodiments of the invention, an article of footwear includes a forefoot portion, a rear portion and a flexure member. The forefoot portion having a forefoot sole and a forefoot upper coupled to the forefoot sole.

The rear portion having a rear sole and a rear upper coupled to the rear sole.

The flexure member has resilient properties. It is coupled to the forefoot sole and the rear sole and located therebetween so that the rear sole and the forefoot sole are spaced apart by the flexure member. Preferably, the flexure member extends across the width of the sole.

DESCRIPTION OF THE PREFERRED EMBODIMENTS

Figure 1:
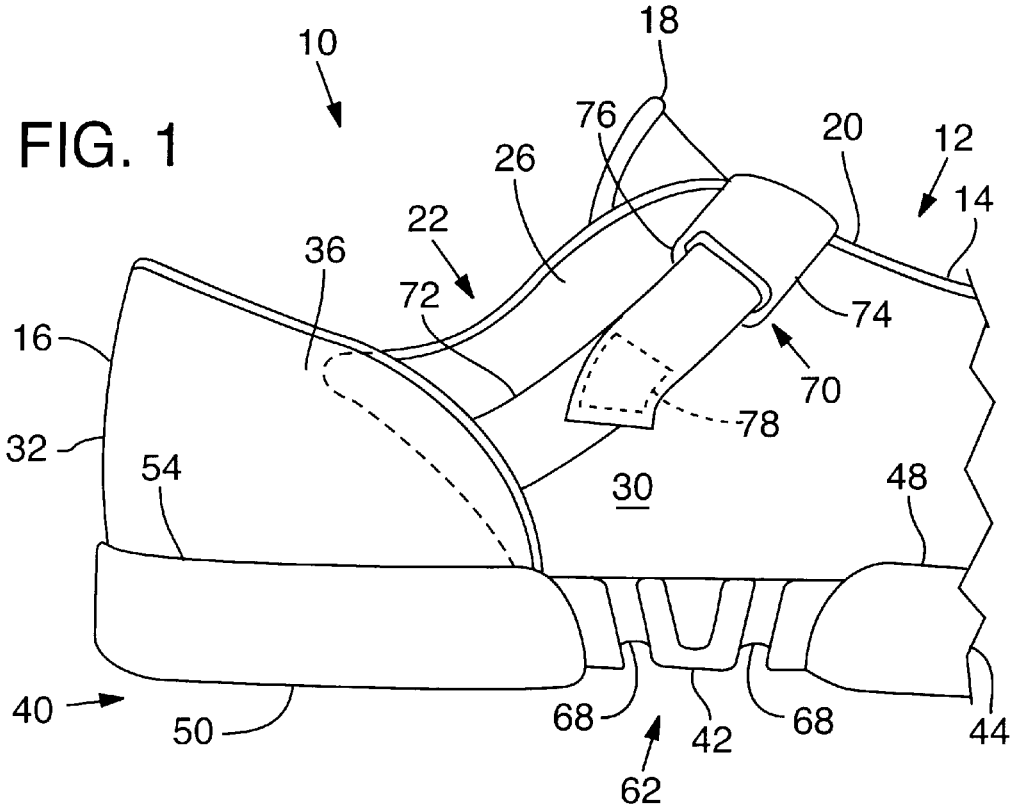
FIG. 1 is a partial side elevation view of an article of footwear of the present invention.

The preferred embodiments will be described with reference to the accompanying figures. FIG. 1 shows an article of footwear 10 of the present invention. Although the invention is shown in embodiments as a shoe and boot, it is intended that the invention could be adapted for incorporation into other types of footwear such as sandals, clogs and athletic footwear.

The footwear 10 includes an upper 12 having forefoot 14 and a rear 16 portions. The forefoot upper 14 further includes a tongue 18 located in a throat 20 of a foot opening 22. Although not shown in the present embodiment, the footwear could include laces threaded through a series of openings along the throat as is conventional in footwear design.

The footwear upper 14 further includes side panels 24 and 26 that extend rearward from the throat. As shown, the side panel 24 (FIG. 6) is on the medial side 28 of the footwear and side panel 26 is on the lateral side 30 of the footwear. These forefoot side panels 24 and 26 may be shaped by internal members (not shown) that provide some rigidity or the forefoot side panels may be soft fabric having form by virtue of their connections to the other parts of the footwear.

The rear upper 16 forms a heel cup 32. A heel counter (not shown) may be used to provide a formed heel or the rear upper 16 may be formed of fabric and maintain its shape by virtue of its connection to other parts of the footwear. The rear upper includes forward extending side panels, medial side panel 34 (FIG. 6) and lateral side panel 36. Preferably, the rear side panels 34 and 36 are located outboard of the forefoot side panels 24 and 26 when the sole is in a relaxed state and the rear upper 16 is connected to the forefoot upper 14.

Figure 5:
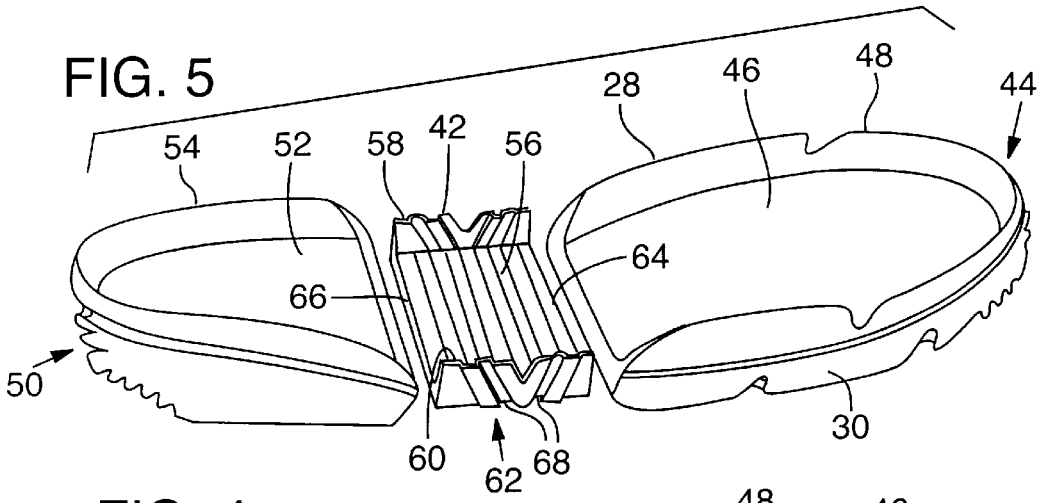
FIG. 5 is an exploded perspective view of the sole of the second embodiment.
Figure 4:
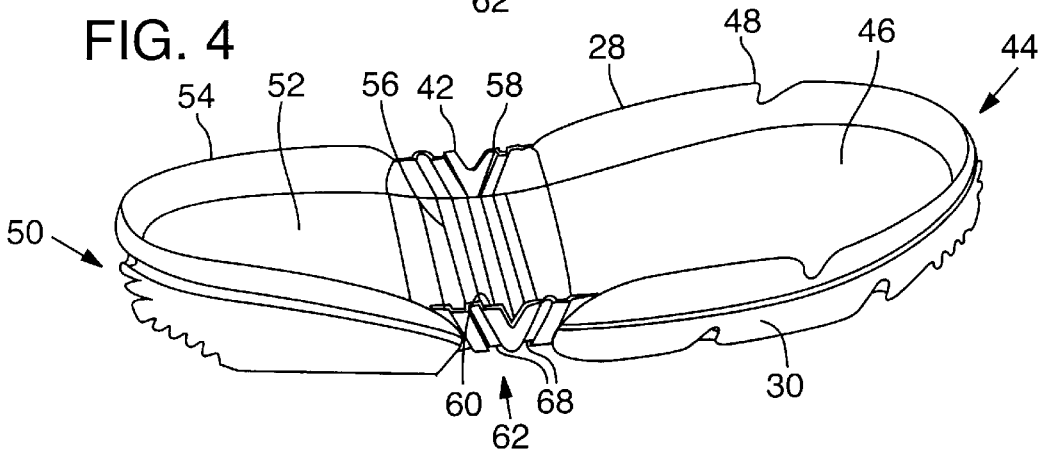
FIG. 4 is a perspective view of the sole of the first embodiment.

The footwear 10 includes a sole 40 having a flexure member 42. With particular reference to FIGS. 4 and 5, the sole 40 includes a forefoot portion 44 having a planar portion 46 and an upward extending flange 48 that follows a margin of the planar portion. The sole 40 further includes a rear portion 50 with a respective planar portion 52 and an upward extending flange 54 that follows a margin of the planar portion.

The flexure member 42 is located between the forefoot portion 44 and the rear portion 50. The flexure member 42 may be integral with the forefoot portion 44 and the rear portion 50, that is, the sole may be of unitary construction such that the flexure member is defined by its structural characteristics as described herein and shown in FIG. 2. In alternative embodiments, the flexure member may be formed separately and coupled to the forefoot and rear portions with adhesive, as shown in FIG. 3, or mechanical connections such as extensions that are molded into the forefoot and rear portions. Such manufacturing techniques are known to those knowledgeable in the art.

The upper 12 is located on the sole 40 and the flanges 48 and 54 extend upward over part of the upper. The sole is coupled to the upper 12 by conventional coupling means such as adhesive or stitching.

In the preferred embodiment, the flexure member 42 includes a bed 56 with an upward extending medial flange 58 and lateral flange 60. The bed extends across the width of the sole at a midfoot location 62 of the footwear. Preferably, a forward margin 64 of the bed 56 is contiguous with a rear margin (not separately numbered) of the forefoot planar portion 46, and a rear margin 66 of the bed 56 is contiguous with a forward margin (not separately numbered) of the rear planar portion 52. Similarly, margins of the flexure member flanges 58 and 60 are contiguous with margins of the forefoot flange 48 and the rear flange 54.

Preferably, the flexure member 42 is less stiff than the rear portion 50 and the forefoot portion 44 so that the footwear 10 can bend at the midfoot 62 in abduction to permit easy entry of a foot into the footwear. In the case of footwear sized for children, an adult can hold the footwear flexed in abduction in one hand and use their second hand to easily insert a child's foot into the footwear.

The flexure member may be made less stiff by choice of material properties or structural properties, or a combination of material and structure. The flexure member may be made of a material having a lower stiffness coefficient than the material of the forefoot portion 44 and the rear portion 50. However, the flexure member must be of a material that can withstand repeated bending cycles.

Alternatively, the flexure member may include a plurality of channels 66. Preferably, the channels extend across the width of the bed 56 and up the flanges 58 and 60. These channels allow the flexure member to be fabricated of a durable material and be relatively flexible.

Figure 2:
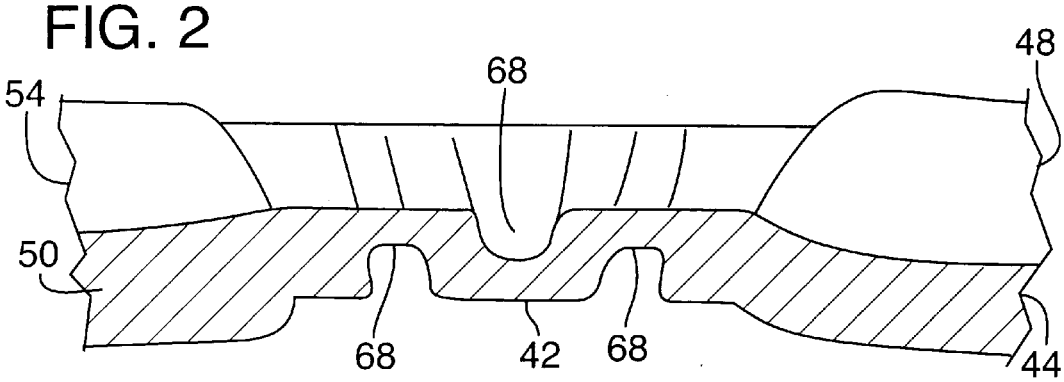
FIG. 2 is an enlarged cross-section view of a portion an unitary sole of the article of footwear of FIG. 1 showing a first embodiment of the sole.
Figure 3:
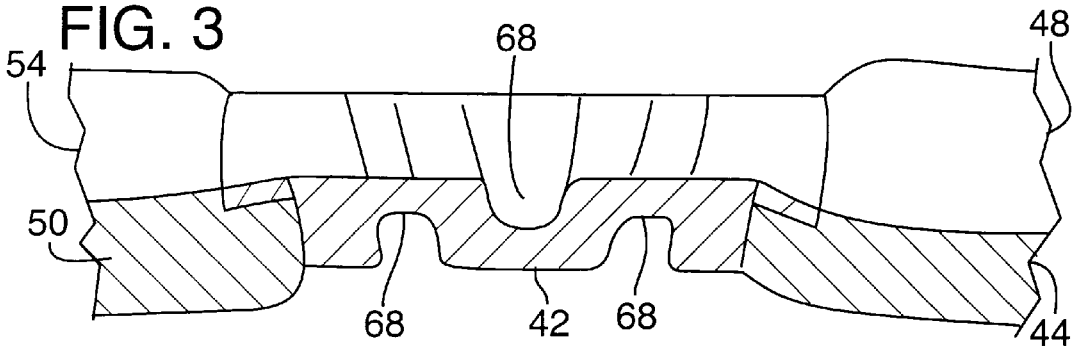
FIG. 3 is an enlarged cross-section view of a portion a sole of the article of footwear of FIG. 1 showing a second embodiment of the sole.

In one embodiment, the flexure member has a relatively uniform thickness as shown in FIGS. 2 and 3. In this embodiment the flexure member performs much like pleated bellows of an accordion. That is, the structure can expand along a surface that is in tension due to bending and can compress along a surface that is in compression due to bending, thereby allowing the member to flex more easily than would be possible with the same material in a non-channel structure.

In alternative embodiments, the flexure member may have varying thickness whereby it is thinnest where a channel 68 is formed and relatively thicker between channels.

Alternatively, the flexure member 42 may be stiffer than the forefoot portion 44 and the rear portion 50 and abduction bending will occur at the flexure member because of the structure of the upper 12. As noted, the upper 12 includes a forefoot portion 14 and a rear portion 16, wherein the forefoot portion and the rear portion are not directly connected. Accordingly, when the footwear 10 is bent in abduction, the fabric of the upper resists stretching the resists the bending moment except at the junction between the forefoot upper 14 and the rear upper 16. Thus, a relatively stiff material may be chosen as the flexure member.

Figure 10:
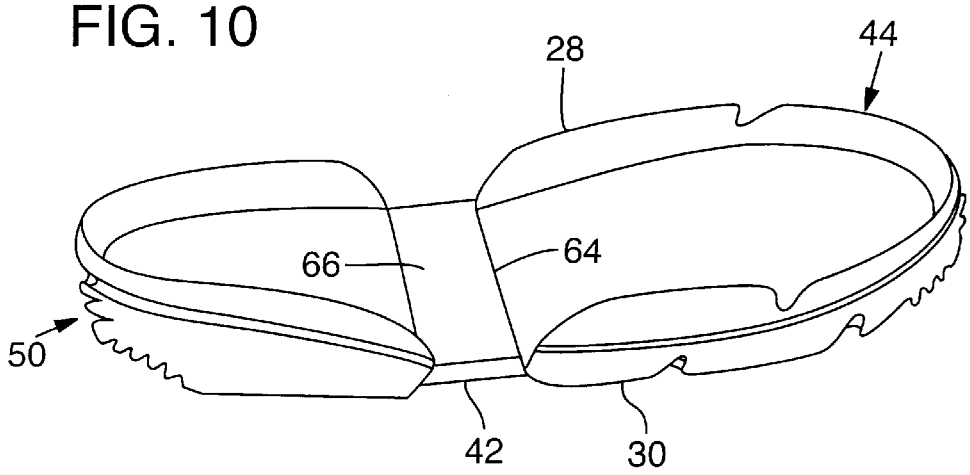
FIG. 10 is a perspective view of an alternative embodiment of a sole of the present invention.

In the embodiment of FIG. 10, the flexure member 42 comprises a planar member that is coupled to the forefoot 44 and rear portions 50 of the sole 40.

In the embodiment of FIGS. 2 and 4, the flexure member and the forefoot and rear sole are of unitary construction. The sole and flexure member may be molded as a single piece or the flexure member may be preformed and inserted in a sole mold and the forefoot and rear soles molded to the flexure member.

In the embodiment of FIGS. 3 and 5 the flexure member is fixedly coupled to the forefoot and rear soles as by adhesion.

Figure 6:
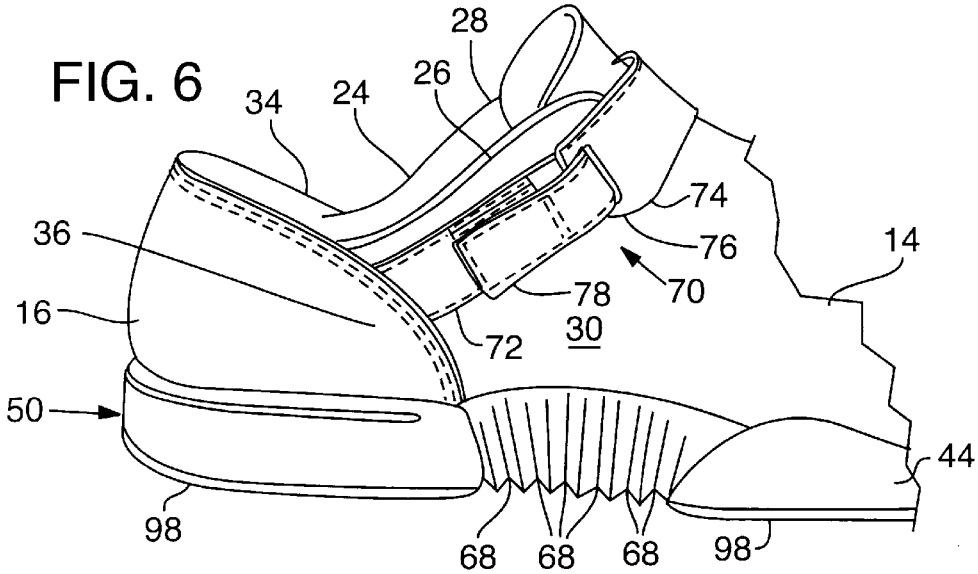
FIG. 6 is a side perspective view of another embodiment of the article of footwear of the present invention.

Preferably, the flexure member is not in contact with a ground surface when a user is walking in the footwear 10. In the embodiments of FIGS. 1 and 6, the forefoot portion 44 and the rear portion 50 are thicker than the flexure member 42 so that the flexure member is essentially suspended above a ground surface by the forefoot portion and the rear portion. Suspending the flexure member prevents wear of the flexure member. Also, when the flexure member is thinner than the forefoot portion and the rear portion, the flexure member has a lower stiffness coefficient that the forefoot portion and the rear portion so that abduction bending of the footwear 10 will cause the footwear to bend at the flexure member 42.

Preferably, the flexure member is an elastic polymer such as compression-molded rubber, Hytrel®, EVA or polyurethane. Other polymers are also suitable. Also, the properties of the flexure member are inherent in the combination of materials and structure. No ferroalloys are necessary to provide biasing or a hinge.

The footwear 10 also includes a closure mechanism 70. Preferably, the closure mechanism is located proximate the foot opening 22 to securely hold the footwear in a closed arrangement when a user is wearing the footwear. The footwear is shown in a closed arrangement in FIGS. 1 and 6, wherein the flexure member 42 is in a relaxed state and the rear planar portion 52 is substantially coplanar with the forefoot planar portion 46.

With reference to FIGS. 1 and 6–9, several embodiments of the closure mechanism 70 are presented. In FIGS. 1 and 6, the closure mechanism 70 comprises a first strap 72 coupled to the rear side panel 36 and a second strap 74 coupled to the forefoot upper 14. The second strap 74 includes a strap receptacle 76 for receiving the first strap 72. An engagement device 78, provides a secure closure for the footwear. In the embodiments of FIGS. 1 and 6, the engagement device is hook and pile that couple securely when pressed together.

Figure 7:
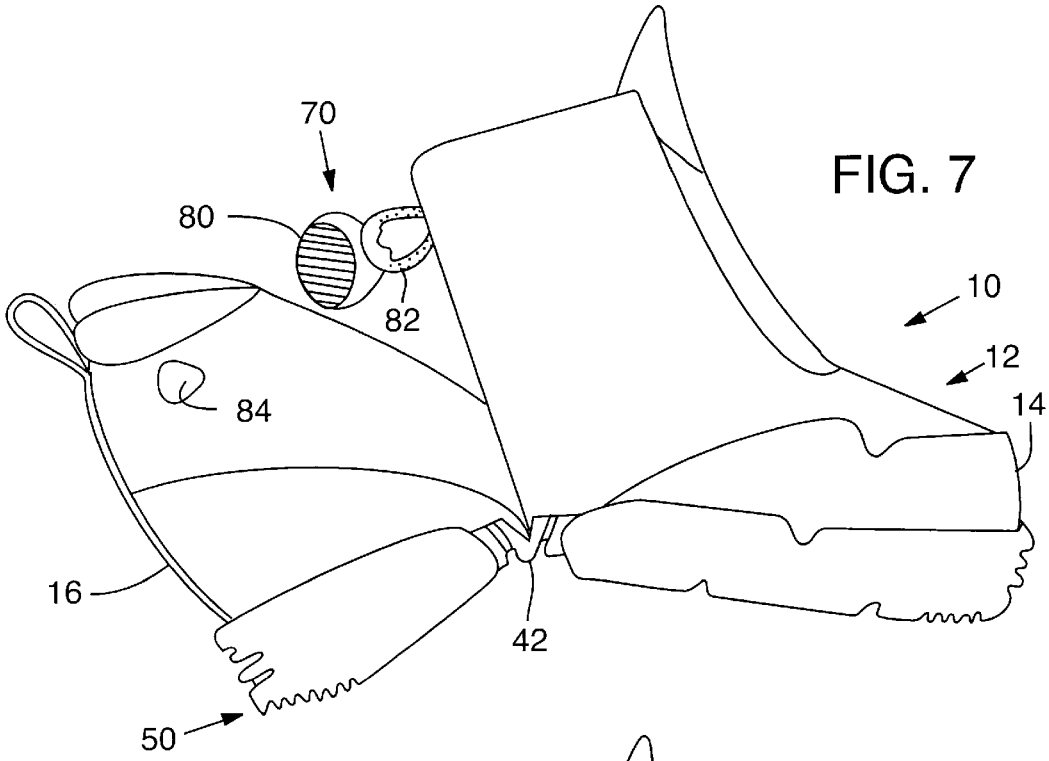
FIG. 7 is a side elevation view of another embodiment of the article of footwear of the present invention showing the footwear partially flexed in abduction.

In FIG. 7, the closure mechanism 70 includes a pull-tab 80 attached to an elastic loop 82 and a post 84 that has a notch (not shown) for receiving the loop.

Figure 8:
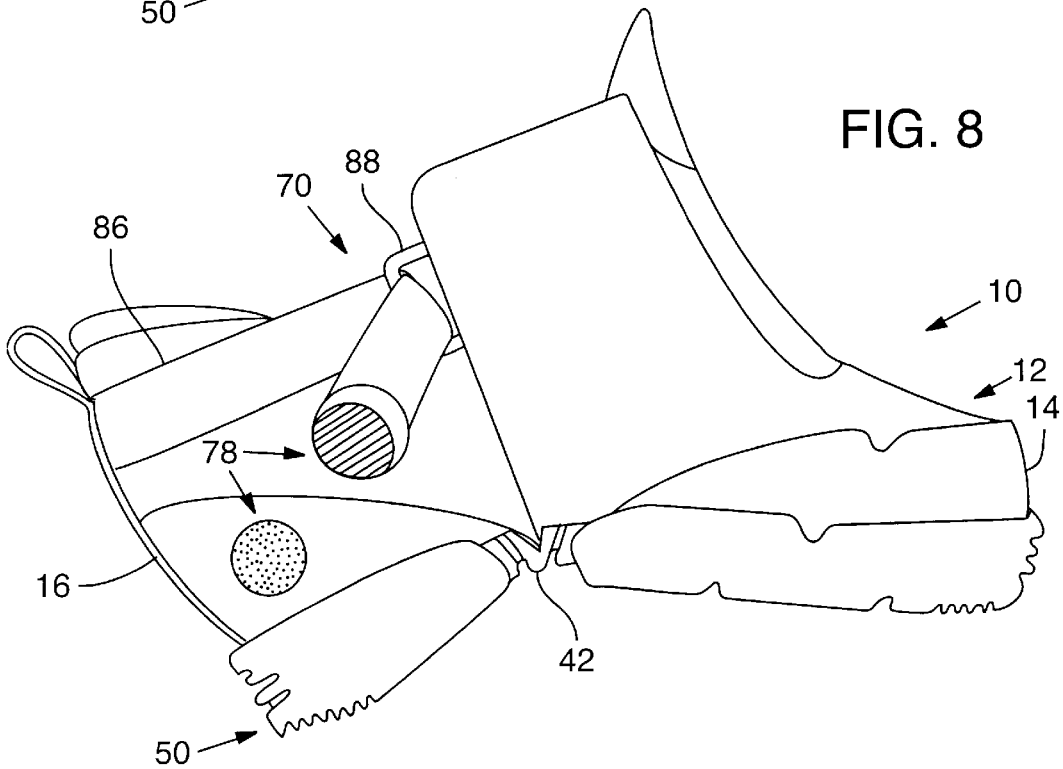
FIG. 8 is a side elevation view of another embodiment of the article of footwear of the present invention showing the footwear partially flexed in abduction.

In FIG. 8, the closure mechanism 70 comprises an elongate strap 86 that passes through a strap receptacle 88 that is attached to the forefoot upper 14. A hook and pile engagement device 78 is located on an end of the strap 86 and on the rear upper 16. When the strap 86 is passed through the receptacle 88, it is doubled back toward the rear and the engagement device may be engaged to securely hold the footwear closed.

Figure 9:
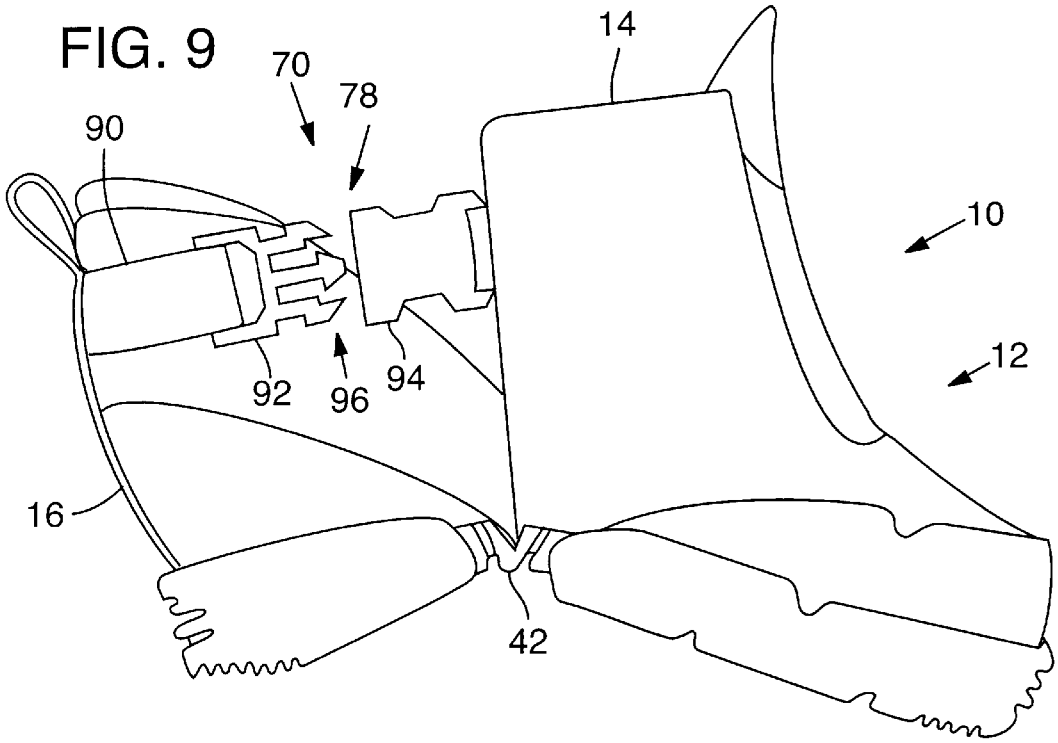
FIG. 9 is a side elevation view of another embodiment of the article of footwear of the present invention showing the footwear partially flexed in abduction.

In FIG. 9, the closure mechanism 70 comprises a strap 90 and an engagement device 78 having male and female portions 92 and 94 of a buckle 96.

The footwear sole may include an outsole 98 (FIG. 6) of a high resistance material on the forefoot sole 44 and the rear sole 50. Preferably, the outsole would be discontinuous at the flexure member 42 so as not to restrict abduction bending at the flexure member.

This specification sets forth the best mode for carrying out the invention as known at the time of filing the patent application and provides sufficient information to enable a person skilled in the art to make and use the invention. The specification further describes materials, shapes, configurations and arrangements of parts for making a using the invention. However, it is intended that the scope of the invention shall be limited by the language of the claims and the law of the land as pertains to valid U.S. patents.

We claim:

1. A method of donning an article of footwear, comprising the steps:

(a) bending a rearfoot portion relative to a forefoot portion about a non-metallic, resilient flexure member that is located between spaced apart forefoot and rearfoot sole portions;

(b) inserting a toe of a wearer's foot into the forefoot portion;

(c) manually releasing the rearfoot portion and the rearfoot portion is moved in adduction relative to the forefoot portion by the flexure member so that the rearfoot portion engages a heel of the wearer; and (d) fastening a closure device so as to couple the forefoot portion and the rearfoot portion and substantially prevent abduction of the footwear.

2. The method of claim 1 wherein the rearfoot sole portion has a leading margin and a trailing margin and the forefoot sole portion has a leading margin and a trailing margin, and wherein the leading edge of the rearfoot sole portion is spaced apart from the trailing edge of the forefoot sole portion, and the flexure member extends between, and couples together, the leading margin of the rearfoot sole portion and the trailing margin of the forefoot sole portion.

3. A method of donning an article of footwear, comprising the steps:

(a) bending the rearfoot portion relative to the forefoot portion about a non-metallic, resilient flexure member that is located between spaced apart forefoot and rearfoot sole portions;

(b) inserting a toe of a wearer's foot into the forefoot portion;

(c) manually releasing the rearfoot portion and the rearfoot portion is moved in adduction relative to the forefoot portion by the flexure member so that the rearfoot portion engages a heel of the wearer;

wherein the flexure member comprises a plurality of channels oriented to facilitate abduction bending of the rearfoot sole portion relative to the forefoot sole portion.

4. An article of footwear comprising:

(a) a forefoot portion having a forefoot sole and a forefoot upper coupled to the forefoot sole, the forefoot sole including a leading margin and a trailing margin;

(b) a rear portion having a rear sole and a rear upper coupled to the rear sole, wherein the rear upper is substantially separable from the forefoot upper, the rear sole including a leading margin and a trailing margin;

(c) a flexure member comprising a resilient material wherein the flexure member is coupled to the trailing margin of the forefoot sole and the leading margin of the rear sole and located therebetween so that the leading margin of the rear sole and the trailing margin of the forefoot sole are spaced apart by the flexure member, and wherein abduction of the rear sole relative to the forefoot sole elastically deforms the flexure member and separates the forefoot upper from the rear upper so that a wearer's foot can move directly into the forefoot portion to don the footwear; and (d) a closure device that selectively couples the forefoot upper to the rear upper and can be operated to decouple the forefoot upper and rear upper during donning of the footwear.

5. A method of donning the article of footwear of claim 4, comprising the steps of operating the closure device to decouple the forefoot upper from the rear upper and manually moving the rear sole relative to the forefoot sole so as to bend the flexure member and inserting a wearer's foot into the forefoot portion and unbending the flexure member so that the rear upper encloses the wearer's heel and fastening the closure device so as to couple the forefoot upper to the rear upper.

6. A method of donning an article of footwear, comprising the steps:

a) bending a rearfoot portion relative to a forefoot portion by flexing a resilient flexure member located between the forefoot portion and the rearfoot portion so that an upper surface of the flexure member is stretched and a lower surface of the flexure member is compressed;

(b) inserting a toe of a wearer's foot into the forefoot portion;

(c) releasing the rearfoot portion so that the flexure member substantially returns to its state before bending so that the rearfoot portion engages a heel of the wearer; and (d) fastening a closure device to secure the footwear onto the wearer.

7. The method of claim 6, wherein the footwear comprises the forefoot portion having a forefoot sole and a forefoot upper coupled to the forefoot sole, the rear portion having a rear sole and a rear upper coupled to the rear sole, wherein the rear upper is substantially separable from the forefoot upper, the flexure member having resilient properties wherein the flexure member is coupled to the forefoot sole and the rear sole and located therebetween so that the rear sole and the forefoot sole are spaced apart by the flexure member, and wherein abduction of the rear sole relative to the forefoot sole elastically deforms the flexure member and separates the forefoot upper from the rear upper so that a wearer's foot can move directly into the forefoot portion to don the footwear, and the closure device can selectively couple the forefoot upper to the rear upper and can be operated to decouple the forefoot upper and rear upper during donning of the footwear.

* * * * *